US011436977B2

(12) United States Patent
Zhang et al.

(10) Patent No.: US 11,436,977 B2
(45) Date of Patent: Sep. 6, 2022

(54) PIXEL DRIVING CIRCUIT, METHOD OF DRIVING THEREOF, AND DISPLAY PANEL

(71) Applicant: WUHAN CHINA STAR OPTOELECTRONICS SEMICONDUCTOR DISPLAY TECHNOLOGY CO., LTD., Wuhan (CN)

(72) Inventors: Shuyuan Zhang, Wuhan (CN); Sunghwan Cho, Wuhan (CN); Chao Dai, Wuhan (CN)

(73) Assignee: WUHAN CHINA STAR OPTOELECTRONICS SEMICONDUCTOR DISPLAY TECHNOLOGY CO., LTD., Wuhan (CN)

( * ) Notice: Subject to any disclaimer, the term of this patent is extended or adjusted under 35 U.S.C. 154(b) by 0 days.

(21) Appl. No.: 17/262,312

(22) PCT Filed: Aug. 17, 2020

(86) PCT No.: PCT/CN2020/109554
§ 371 (c)(1),
(2) Date: Jan. 22, 2021

(87) PCT Pub. No.: WO2022/011769
PCT Pub. Date: Jan. 20, 2022

(65) Prior Publication Data

US 2022/0157239 A1 May 19, 2022

(30) Foreign Application Priority Data

Jul. 17, 2020 (CN) ..... 202010694693.4

(51) Int. Cl.
*G09G 3/3233* (2016.01)

(52) U.S. Cl.
CPC ... *G09G 3/3233* (2013.01); *G09G 2300/0842* (2013.01); *G09G 2310/061* (2013.01); *G09G 2320/0214* (2013.01)

(58) Field of Classification Search
CPC .. G09G 3/3233; G09G 3/3258; G09G 3/3291; G09G 3/3275; G09G 2300/0819;
(Continued)

(56) References Cited

U.S. PATENT DOCUMENTS

2005/0017934 A1* 1/2005 Chung ..... G09G 3/3233 345/82
2009/0027310 A1* 1/2009 Kim ..... G09G 3/3233 345/76

(Continued)

*Primary Examiner* — Dong Hui Liang
(74) *Attorney, Agent, or Firm* — The Roy Gross Law Firm, LLC; Roy Gross

(57) ABSTRACT

A pixel driving circuit, a method of driving thereof, and a display panel are provided. The pixel driving circuit includes a driving transistor and a compensation module, which at least includes different types of initialization transistors and compensation transistors. The compensation transistor transmits a data signal with a compensation threshold voltage to the gate of the driving transistor. The initialization transistor transmits the variable potential signal to the gate of the driving transistor to dynamically compensate the gate voltage of the driving transistor during the light-emitting phase, thereby improving the display effect.

19 Claims, 6 Drawing Sheets

(58) Field of Classification Search
CPC ... G09G 2300/0842; G09G 2300/0861; G09G 2300/0866; G09G 2300/0852; G09G 2300/0439; G09G 2320/0233; G09G 2320/043; G09G 2320/045; G09G 2310/06; G09G 2310/0251; G09G 2310/061
See application file for complete search history.

(56) References Cited

U.S. PATENT DOCUMENTS

| | | | | |
|---|---|---|---|---|
| 2009/0201231 | A1* | 8/2009 | Takahara | G09G 3/3233 345/76 |
| 2016/0275869 | A1* | 9/2016 | Hwang | G09G 3/3258 |
| 2018/0061915 | A1* | 3/2018 | Yu | H01L 27/3248 |
| 2018/0122298 | A1* | 5/2018 | Lee | G09G 3/3233 |

* cited by examiner

PIXEL DRIVING CIRCUIT, METHOD OF DRIVING THEREOF, AND DISPLAY PANEL

CROSS REFERENCE TO RELATED APPLICATIONS

This application is a National Phase of PCT Patent Application No. PCT/CN2020/109554 having International filing date of Aug. 17, 2020, which claims the benefit of priority of Chinese Application No. 202010694693.4 filed Jul. 17, 2020. The contents of the above applications are all incorporated by reference as if fully set forth herein in their entirety.

BACKGROUND OF INVENTION

Field of Invention

The present invention relates to a display technology, and more particularly, to a pixel driving circuit, a method of driving thereof, and a display panel.

Description of Prior Art

Backplates made of low-temperature polysilicon technology make display panels achieve a higher pixel density, but a leakage current of silicon transistors is large, so when the display panels adopt a low refresh frequency, display effect of the display panels is poor, which affects display quality.

SUMMARY OF INVENTION

A pixel driving circuit, a method of driving thereof, and a display panel are provided, which can maintain a stable gate voltage of a driving transistor, reduce an influence of a source or a drain of the driving transistor on the gate of the driving transistor, so as to improve a display effect of the display panel.

A pixel driving circuit comprises: a light-emitting device, a driving transistor, and a compensation module, wherein the compensation module at least comprises an initialization transistor and a compensation transistor;

wherein the initialization transistor is configured to respond to a first scan signal and transmit a potential variable signal to a gate of the driving transistor to initialize a gate voltage of the driving transistor;

wherein the compensation transistor is configured to respond to a compensation control signal and transmit a data signal with a compensation threshold voltage to the gate of the driving transistor; and wherein the initialization transistor and the compensation transistor are different types, and the potential variable signal dynamically compensates the gate voltage of the driving transistor during light-emitting phase.

In one embodiment, the initialization transistor is one of silicon transistor or oxide transistor, and the compensation transistor is another one of the silicon transistor or the oxide transistor.

In one embodiment, the initialization transistor is a silicon transistor, and the compensation transistor is an oxide transistor.

In one embodiment, the initialization transistor is a P-type transistor, and the compensation transistor is an N-type transistor.

In one embodiment, the potential variable signal is a constant low-level signal when the initialization transistor responds to the first scan signal and the compensation transistor responds to the compensation control signal, and the potential variable signal is a continuous rising signal in a light-emitting phase, In one embodiment, the pixel driving circuit further comprises a data writing module, and data writing module is configured to respond a second scan signal and transmit the data signal to a source or a drain of the driving transistor.

In one embodiment, the pixel driving circuit further comprises a storage module, wherein the storage module is configured to maintain the gate voltage of the driving transistor.

In one embodiment, the pixel driving circuit further comprises a light control module, wherein the light control module is configured to control the light-emitting device to emit light in response to a light emitting control signal.

In one embodiment, the pixel driving circuit further comprises a reset module, wherein the reset module is configured to respond to a second scan signal and transmit a reset signal to an anode of the light-emitting device.

In one embodiment, the reset signal is a constant signal.

In one embodiment, the light emitting device D1 comprises one of an organic light-emitting diode, a sub-millimeter light-emitting diode, and a micro light-emitting diode.

A method of driving a pixel driving circuit, the method drives the pixel driving circuit of claim 1, in the $N_{th}$ frame period, the method comprises:

in an initialization phase, wherein an initialization transistor of a compensation module responds to a first scan signal, and a potential variable signal is transmitted to a gate of a driving transistor to initialize a gate voltage of the driving transistor;

in a compensation phase, wherein a compensation transistor of the compensation module responds to a compensation control signal to transmit a data signal with a compensation threshold voltage to the gate of the driving transistor to compensate a threshold voltage of the driving transistor; and in a light-emitting phase, wherein the driving transistor drives the light-emitting device to emit light, and the potential variable signal dynamically compensates the gate voltage of the driving transistor.

In one embodiment, the potential variable signal is a constant signal during the initialization phase and the compensation phase, and the potential variable signal continuously rises or falls with the gate voltage of the driving transistor before compensation in the light-emitting phase.

A display panel comprises: a plurality of pixels and a pixel driving circuit controlling the pixels to emit light. The pixel driving circuit comprises:

a light-emitting device forming the pixels;

a driving transistor configured to provide a driving current to the light-emitting device;

a potential variable signal line configured to provide potential variable signal, an initialization transistor; and a compensation transistor;

wherein the initialization transistor and the compensation transistor have semiconductor layers made of different materials;

wherein a gate of the compensation transistor is connected to a compensation control signal line, one of source or drain of the compensation transistor is connected to a gate of the driving transistor, and another of the source or the drain is connected to a source or a drain of the driving transistor; and wherein a gate of the initialization transistor is connected to a scan signal line, one of the source or the drain of the initialization transistor is connected to the potential variable signal line, and another of the source or the drain of the initialization transistor is connected to the gate of the driving transistor.

In one embodiment, the semiconductor layers of the initialization transistor and the compensation transistor have different carrier mobilities; a carrier mobility of the semiconductor layer of the initialization transistor is greater than a carrier mobility of the semiconductor layer of the compensation transistor; or a carrier mobility of the semiconductor layer of the initialization transistor is less than a carrier mobility of the semiconductor layer of the compensation transistor.

In one embodiment, the pixel driving circuit further comprises:

a data writing transistor, and a gate of the data writing transistor is connected to a second scan signal line, one of source or drain of the data writing transistor is connected to a data signal line, and another of the source or the drain is connected to one of the source or the drain of the driving transistor; and a storage capacitor, and an upper plate of the storage capacitor is connected to a first voltage terminal, a lower plate of the of the storage capacitor is connected to a source or a drain of the initialization transistor or a gate of the driving transistor, and a source or a drain of the compensation transistor is connected to one of the gate of the driving transistor and a gate of the initialization transistor.

In one embodiment, the pixel driving circuit further comprises:

a first switch transistor, and a gate of the first switch transistor is connected to a light-emitting control signal line, one of source or drain of the first switch transistor is connected to a first voltage terminal, and another of the source or the drain the first switch transistor is connected to one of the source or the drain of the driving transistor; and a second switch transistor, and a gate of the second switch transistor is connected to the light-emitting control signal line, one of source or drain of the second switch transistor is connected to the source or the drain of the driving transistor, and another of the source or the of the driving transistor is connected to an anode of the light-emitting device.

In one embodiment, the pixel driving circuit further comprises:

a reset transistor, wherein a gate of the reset transistor is connected to the second scan signal line, one of source or drain of the reset transistor is connected to a reset signal line, and another of the source or the drain of the reset transistor is connected to an anode of the light-emitting device, and the reset transistor and the initialization transistor have a semiconductor layer made of a same material.

In one embodiment, the display panel further comprises a conductive layer disposed between the pixel driving circuit and the light-emitting device, the conductive layer overlaps with an orthographic projection of the compensation transistor in a top view, and the conductive layer covers the compensation transistor.

In one embodiment, material of the conductive layer comprises at least one of gold, silver, copper, lithium, sodium, potassium, magnesium, aluminum, and zinc.

The present invention has beneficial effects described as follows. Compared to the prior art, a pixel driving circuit, a method of driving thereof, and a display panel are provided. The pixel driving circuit comprises: a light-emitting device, a driving transistor, and a compensation module, wherein the compensation module at least comprises an initialization transistor and a compensation transistor; wherein the initialization transistor is configured to respond to a first scan signal and transmit a potential variable signal to a gate of the driving transistor to initialize a gate voltage of the driving transistor; wherein the compensation transistor is configured to respond to a compensation control signal and transmit a data signal with a compensation threshold voltage to the gate of the driving transistor; and wherein the initialization transistor and the compensation transistor are different types, and the potential variable signal dynamically compensates the gate voltage of the driving transistor during light-emitting phase, so as to maintain the gate voltage of the driving transistor stable during the light-emitting phase, and reduce the influence of the source or drain of the driving transistor on the gate of the driving transistor, which improves the display effect of the display panel.

DETAILED DESCRIPTION OF PREFERRED EMBODIMENTS

In order to make the purpose, technical solutions and effects of this application clearer and clearer, the following further describes this application in detail with reference to the drawings and embodiments. It should be understood that the specific embodiments described herein are only used to explain the application, and not used to limit the application.

Figure 1:
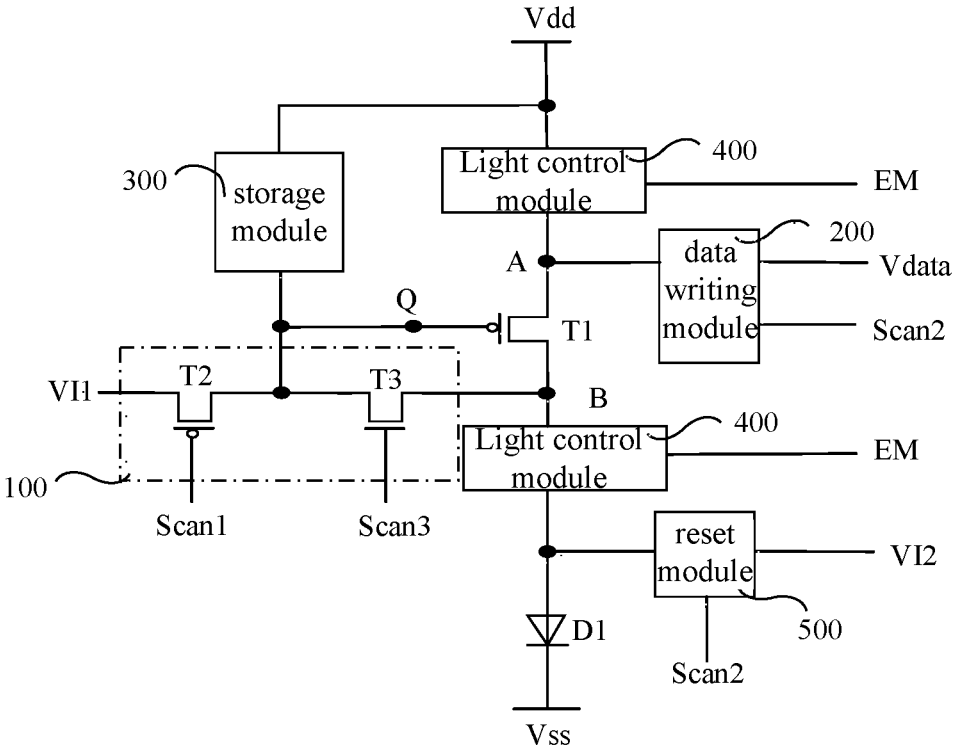
FIG. 1 is a schematic view of a pixel driving circuit according to one embodiment of the present invention.
Figure 2A:
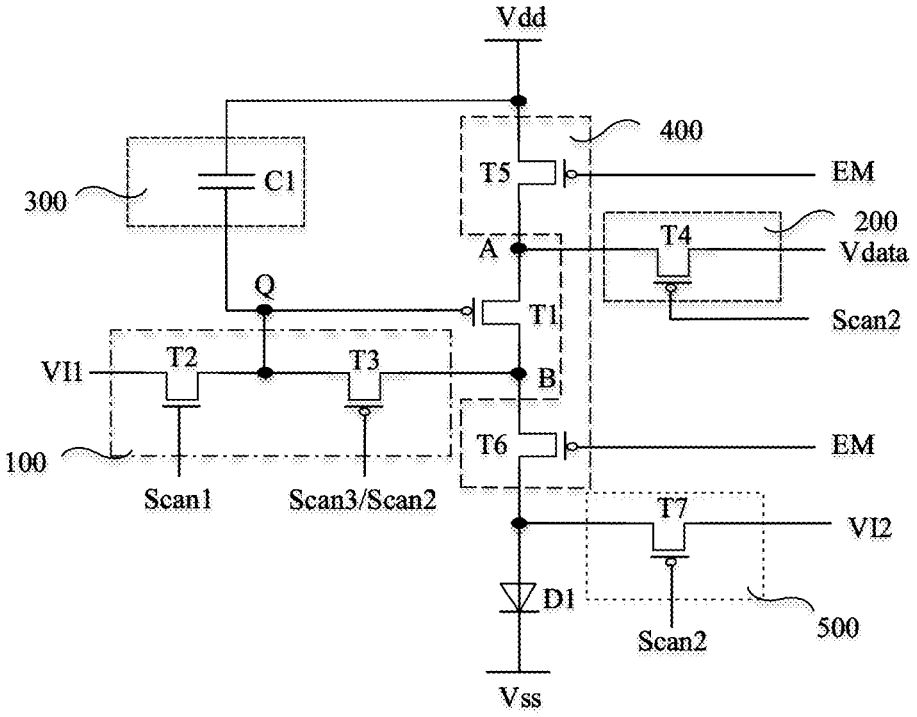
FIG. 2A and FIG. 2B are structural schematic views of pixel driving circuits according to one embodiment of the present invention.
Figure 2B:
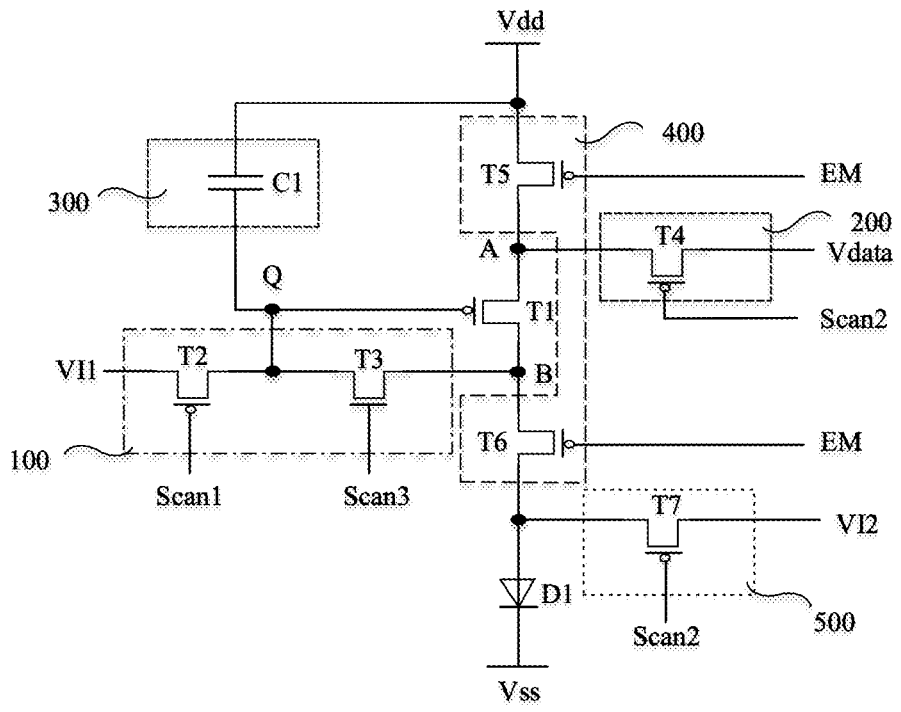
Figure 3A:
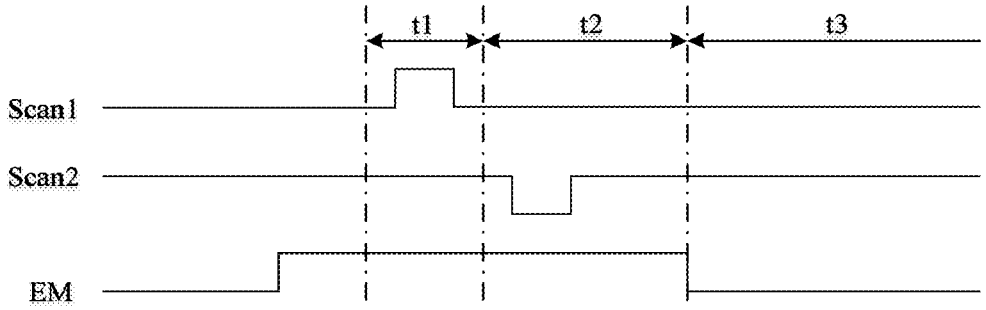
FIG. 3A is a working timing view of the pixel driving circuit in FIG. 2A.
Figure 3B:
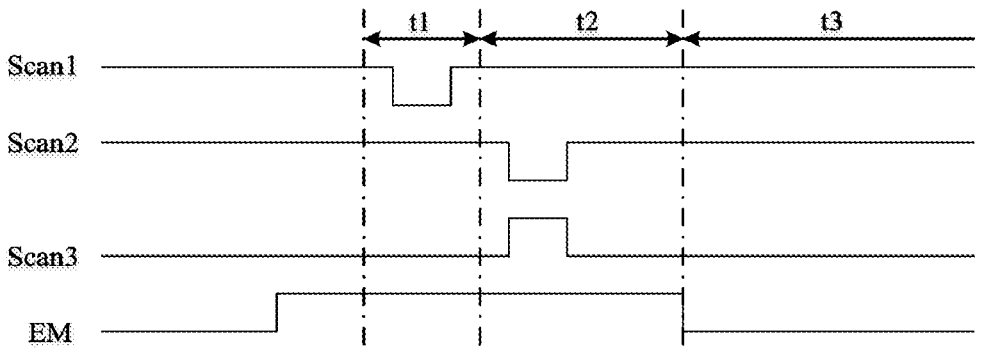
FIG. 3B is a working timing view of the pixel driving circuit in FIG. 2B.
Figure 3C:
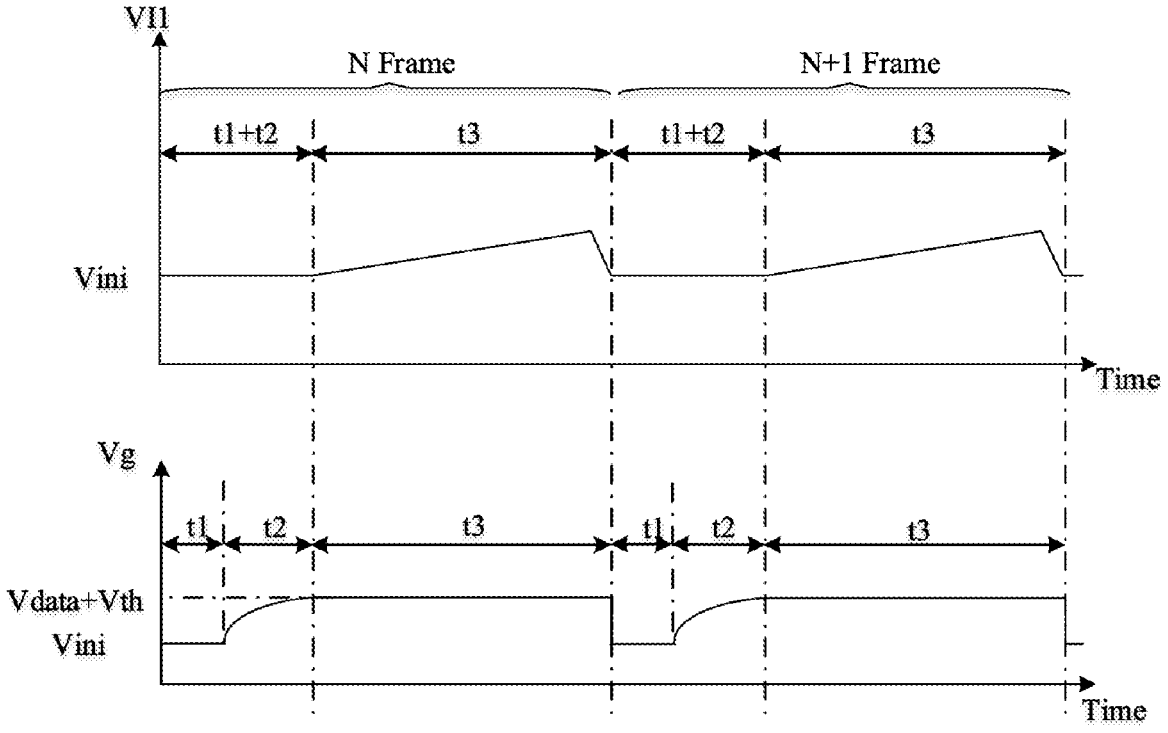
FIG. 3C is a working timing view of a potential variable signal and a gate voltage of the driving transistor according to one embodiment of the present invention.

Specifically, FIG. 1 is a schematic view of a pixel driving circuit according to one embodiment of the present invention. FIG. 2A and FIG. 2B are structural schematic views of pixel driving circuits according to one embodiment of the present invention. FIG. 3A is a working timing view of the pixel driving circuit in FIG. 2A. FIG. 3B is a working timing view of the pixel driving circuit in FIG. 2B. FIG. 3C is a working timing view of a potential variable signal and a gate voltage of the driving transistor according to one embodiment of the present invention.

In one embodiment, a pixel driving circuit comprises: a light-emitting device D1, a driving transistor T1, and a compensation module 100. The compensation module 100 at least comprises an initialization transistor T2 and a compensation transistor T3.

The initialization transistor T2 is configured to respond to a first scan signal (Scan1) and transmit a potential variable signal VI1 to a gate of the driving transistor T1 to initialize a gate voltage of the driving transistor T1.

The compensation transistor T3 is configured to respond to a compensation control signal (Scan3) and transmit a data signal (Vdata) with a compensation threshold voltage to the gate of the driving transistor.

The initialization transistor T2 and the compensation transistor T3 are different types, and the potential variable signal VI1 dynamically compensates the gate voltage Vg of the driving transistor T1 during light-emitting phase.

Furthermore, the initialization transistor T2 is one of silicon transistor or oxide transistor, and the compensation transistor T3 is another one of the silicon transistor or the oxide transistor.

Specifically, referring to FIG. 2A to FIG. 2B and FIG. 3A to FIG. 3B, in a light-emitting phase t3, the compensation transistor T3 can reduce the influence of one of the source or drain (point B) of the driving transistor T1 on the voltage Vg of the gate (point Q) of the driving transistor T1.

However, the compensation transistor T3 has a certain leakage current. In order to reduce the influence of the leakage current of the compensation transistor T3 on the driving transistor T1, the leakage current characteristics of the initialization transistor T2 and the potential variable signal VI1 are used to dynamically compensate the leakage current caused by the compensation transistor T3. The influence on the gate voltage Vg of the driving transistor T1 so as to keep the gate voltage Vg of the driving transistor T1 constant to ensure the stable light emission of the light-emitting device D1. Furthermore, it is ensured that the light-emitting device D1 can achieve stable light emission at any refresh frequency.

Furthermore, the initialization transistor T2 is an oxide transistor, and the compensation transistor T3 is a silicon transistor. However, the leakage current of a silicon transistor is greater than that of an oxide transistor. When the initialization transistor T2 is an oxide transistor and the compensation transistor T3 is a silicon transistor, the leakage current of the compensation transistor T3 is greater than the leakage current of the initialization transistor T2, which affects the compensation effect of the potential variable signal VI1 on the gate voltage Vg of the driving transistor T1.

Therefore, in order to improve the compensation effect of the gate voltage Vg of the driving transistor T1, the initialization transistor T2 is a silicon transistor, and the compensation transistor T3 is an oxide transistor. Utilizing the characteristic that a leakage current of the compensation transistor T3 is less than a leakage current of the initialization transistor T2, so as to reduce the influence of one of the source or drain (point B) of the driving transistor T1 on the voltage Vg of the gate (point Q) of the driving transistor T1. Utilizing the characteristic of the initialization transistor T2 having a relatively large leakage current, the potential variable signal VI1 reduces the influence of the leakage current of the compensation transistor T3 on the driving transistor T1, so that the gate voltage Vg of the driving transistor T1 is kept constant, which ensures the stable light emission of the light-emitting device D1

The initialization transistor T2 and the compensation transistor T3 may be P-type transistors or N-type transistors. Furthermore, because P-type oxide transistors are restricted by current P-type oxide materials, the preparation of high-quality P-type oxide transistors is also restricted. Therefore, based on the prior art, when the initialization transistor T2 or the compensation transistor T3 is an oxide transistor, an N-type oxide transistor is selected. However, it does not limit the oxide transistor in the present invention to be an N-type transistor, and the oxide transistor in the present invention may also be a P-type transistor.

The silicon transistor comprises a monocrystalline silicon transistor, a polycrystalline silicon transistor, a microcrystalline silicon transistor, an amorphous silicon or other silicon-containing transistor. The oxide transistor comprises an oxide transistor containing metals such as zinc, indium, gallium, tin, or titanium, and their oxides. Furthermore, the polysilicon transistor comprises a low temperature polysilicon transistor. The oxide transistor comprises an oxide transistor zinc oxide, zinc tin oxide, zinc indium oxide, indium oxide, titanium oxide, indium gallium zinc oxide, indium zinc tin oxide, etc.

Referring to FIG. 1 and FIG. 2A to FIG. 2B, the pixel driving circuit further comprises a data writing module 200, and the data writing module 200 is configured to respond to the second scan signal (Scan2) and transmits the data signal (Vdata) to the source or the drain of the driving transistor T1.

When the compensation transistor T3 adopts the same type of transistor as the data writing transistor T4. The compensation transistor T3 can directly use the second scan signal (Scan2) to replace the compensation control signal (Scan3).

Specifically, referring to FIG. 2A to FIG. 2B, the data writing module 200 comprises a data writing transistor T4, the gate of the data writing transistor T4 is connected to the second scan signal (Scan2). The data signal Vdata is transmitted to the first electrode of the data writing transistor T4, and the second electrode of the data writing transistor T4 is connected to the first electrode of the driving transistor T1.

The pixel driving circuit further comprises a storage module 300. The storage module is configured to maintain the gate voltage Vg of the driving transistor T1.

Specifically, referring to FIG. 2A to FIG. 2B, the storage module 300 comprises a storage capacitor C1, one end of the storage capacitor C1 is connected to the first voltage terminal Vdd, and the other end of the storage capacitor C1 is connected to the gate of the driving transistor T1, the second electrode of the initialization transistor T2, and the first electrode of the compensation transistor T3. Specifically, the upper plate of the storage capacitor C1 is connected to the first voltage terminal Vdd, the lower plate of the storage capacitor C2 is connected to the gate of the driving transistor T1, the second electrode of the initialization transistor T2, and the first electrode of the compensation transistor T3 is connected.

The pixel driving circuit further comprises a light-emitting control module 400. The light control module 400 is configured to control the light emitting device D1 to emit light in response to the light-emitting control signal EM.

Specifically, referring to FIG. 2A to FIG. 2B, the light control module 400 comprises a first switch transistor T5 and a second switch transistor T6. The light-emitting control signal EM is transmitted to the gate of the first switch transistor T5 and the gate of the second switch transistor T6. The first electrode of the first switch transistor T5 is connected to the first voltage terminal Vdd, and the second electrode of the first switch transistor T5 is connected to the first electrode of the driving transistor T1. The first electrode of the second switch transistor T6 is connected to the second electrode of the driving transistor T1, and the second electrode of the second switch transistor T6 is connected to the anode of the light-emitting device D1.

The pixel driving circuit further comprises a reset module 500, and the reset module 500 is configured to respond to the second scan signal (Scan2) and transmit the reset signal VI2 to the anode of the light-emitting device D1.

Specifically, referring to FIG. 2A to FIG. 2B, the reset module 500 comprises a reset transistor T7. The second scan signal (Scan2) is transmitted to the gate of the reset transistor T7, the reset signal VI2 is transmitted to the first electrode of the reset transistor T7, and the second electrode of the reset transistor T7 is connected to the anode of the light-emitting device D1.

The reset signal VI2 is a constant signal. In a light-emitting phase t3, the required variable potential signal VI1 can be provided by a driving chip.

The types of the reset transistor T7 and the initialization transistor T2 may be different or the same. Specifically, in the pixel driving circuit shown in FIG. 2A, the reset transistor T7 and the initialization transistor T2 are different types. Furthermore, the reset transistor T7 and the compensation transistor T3 are the same types. In the pixel driving circuit shown in FIG. 2B, the reset transistor T7 and the initialization transistor T2 are the same types. Furthermore, the reset transistor T7 and the compensation transistor T3 are different types.

The light emitting device D1 comprises one of an organic light-emitting diode, a sub-millimeter light-emitting diode, and a micro light-emitting diode.

In the pixel driving circuits shown in FIG. 2A to FIG. 2B, the cathode of the light emitting device D1 is connected to the second voltage terminal Vss as an example. In addition, the light-emitting device D1 can also be arranged in the pixel driving circuit in the form of an anode connected to the first voltage terminal Vdd, which will not be repeated herein.

In order to distinguish the source and drain of the transistor other than the gate, the first electrode of the present invention can be one of the drain or the source, and the second electrode is the other of the source or the drain.

Furthermore, method of driving a pixel driving circuit is provided, and it is used for driving the pixel driving circuit. In an $N_{th}$ frame period (N Frame), the driving method comprises:

in an initialization phase t1, and an initialization transistor T2 of a compensation module 100 responds to a first scan signal (Scan1), and a potential variable signal VI1 is transmitted to a gate of a driving transistor T1 to initialize a gate voltage Vg of the driving transistor T1;

in a compensation phase t2, and a compensation transistor T3 of the compensation module 100 responds to a compensation control signal (Scan3) to transmit a data signal (Vdata) with a compensation threshold voltage to the gate of the driving transistor T1 to compensate a threshold voltage of the driving transistor T1; and in a light-emitting phase t3, and the driving transistor T1 drives the light-emitting device D1 to emit light, and the potential variable signal VI1 dynamically compensates the gate voltage Vg of the driving transistor.

The potential variable signal VI1 is a constant signal during the initialization phase t1 and the compensation phase t2, and the potential variable signal VI1 continuously rises or falls with the gate voltage Vg of the driving transistor before compensation in the light-emitting phase t3.

Specifically, in the light-emitting phase t3, since the gate of the driving transistor T1 is affected by the source or drain (point B) of the driving transistor T1, the gate voltage Vg of the driving transistor T1 is continuously changed. Therefore, in order to keep the gate voltage Vg of the driving transistor T1 stable, the amplitude of the variable potential signal VI1 is proportional to the gate voltage Vg of the driving transistor T1 before compensation.

In timing, the potential variable signal VI1 continuously rises with the decrease of the gate voltage Vg of the driving transistor T1 before compensation, or continuously decreases with the increase of the gate voltage Vg of the drive transistor T1 before compensation, so that the gate voltage Vg of the driving transistor T1 remains stable after compensation.

In the light-emitting phase t3, the required variable potential signal VI1 can be provided by a driving chip. The reset signal VI2 and the amplitude of the potential variable signal VI1 during the initialization phase t1 and the compensation phase t2 may be equal to or not equal to each other, which will not be repeated herein.

The working principle of driving the pixel driving circuit by the driving method is described in detail below with reference to FIG. 2A to FIG. 2B and FIG. 3A to FIG. 3B.

Referring to FIG. 2A and FIG. 3A, the driving transistor T1, the compensation transistor T3, the data writing transistor T4, the first switch transistor T5, the second switch transistor T6, and the reset transistor T7 are P-type silicon transistors, and the initialization transistor T2 is an N-type oxide transistor. The compensation transistor T3 and the data writing transistor T4 share the second scan signal (Scan2) as an example. The $N_{th}$ frame period (N Frame) comprises the initialization phase t1, the compensation phase t2, and the light-emitting phase t3.

In the initialization phase t1, the initialization transistor T2 responds to the first scan signal (Scan1), the initialization transistor T2 is turned on, and the potential variable signal VI1 is transmitted to the gate of the driving transistor T1. The lower plate of the storage capacitor C1 is connected to the variable potential signal VI1, the voltage difference between the upper plate and the lower plate of the storage capacitor C1 becomes larger, the storage capacitor C1 is charged, and the driving transistor T1 The gate voltage Vg of is reset to the low level signal Vini by the potential variable signal VI1, and the driving transistor T1 is turned on to realize the initialization of the driving transistor T1.

In the compensation phase t2, the compensation transistor T3, the data writing transistor T4, and the reset transistor T7 are turned on in response to the second scan signal Scan2, and the data signal Vdata is transmitted to the first electrode (point A) of the drive transistor T1. The compensation transistor T3 is turned on so that the gate of the driving transistor T1 is connected to the second electrode. The data signal Vdata having the function of compensating the threshold voltage Vth is transmitted to the gate of the driving transistor T1. The existence of the storage capacitor C1 makes the gate voltage Vg of the driving transistor T1 gradually rise from Vini until the driving transistor T1 is fully turned on. The storage capacitor C1 maintains the gate voltage Vg of the driving transistor T1, thereby realizing compensation for the threshold voltage Vth of the driving transistor T1. The conduction of the reset transistor T7 enables the reset signal VI2 to be transmitted to the anode of the light-emitting device D1, so as to realize the initialization of the light-emitting device D1.

In the light-emitting stage t3, the first switch transistor T5 and the second switch transistor T6 are turned on in response to the light-emitting control signal EM. The driving transistor T1 forms a driving current to drive the light emitting device D1 to emit light.

The compensation transistor T3 in the off state is used to reduce the influence of the second electrode (point B) of the driving transistor T1 on the voltage Vg of the gate (point Q) of the driving transistor T1. Using the leakage current characteristic of the initialization transistor T2 in the off state and the potential variable signal VI1 to dynamically compensate the influence of the leakage current of the compensation transistor T3 on the gate voltage Vg of the driving transistor T1, so that the gate voltage Vg of the driving transistor T1 is kept stable, that is, Vg is kept at Vdata+Vth to ensure the stable light emission of the light-emitting device D1.

Similarly, referring to FIG. 2B and FIG. 3B, the driving transistor T1, the initialization transistor T2, the data writing transistor T4, the first switch transistor T5, the second switch transistor T6, and the reset transistor T7 are P-type silicon transistors, and the compensation transistor T3 is an N-type oxide transistor. The $N_r$h frame period (N Frame) comprises the initialization phase t1, the compensation phase t2, and the light-emitting phase t3.

In the initialization phase t1, the initialization transistor T2 responds to the first scan signal (Scan1), the initialization transistor T2 is turned on. The potential variable signal VI1 is transmitted to the gate of the driving transistor T1. The storage capacitor C1 is charged. The gate voltage Vg of the driving transistor T1 is reset to the low-level signal Vini by the potential variable signal VI1, and the driving transistor T1 is turned on to realize the initialization of the driving transistor T1.

In the compensation phase t2, the compensation transistor T3 is turned on in response to the compensation control signal (Scan3), the data writing transistor T4 and the reset transistor T7 are turned on in response to the second scan signal (Scan2), and the data signal Vdata is transmitted to the first electrode (point A) of the driving transistor T1. The compensation transistor T3 is turned on so that the gate of the driving transistor T1 is connected to the second electrode, and the data signal Vdata having the function of compensating the threshold voltage Vth is transmitted to the gate of the driving transistor T1. The existence of the storage capacitor C1 causes the gate voltage Vg of the driving transistor T1 to gradually rise from Vini until the driving transistor T1 is fully turned on, and the storage capacitor C1 maintains the gate voltage Vg of the driving transistor T1, so as to realize the compensation of the threshold voltage Vth of the driving transistor T1. The conduction of the reset transistor T7 enables the reset signal VI2 to be transmitted to the anode of the light-emitting device D1, so as to realize the initialization of the light-emitting device D1.

In the light-emitting phase t3, the first switch transistor T5 and the second switch transistor T6 are turned on in response to the light-emitting control signal EM, and the driving transistor T1 forms a driving current to drive the light-emitting device D1 to emit light. Using the compensation transistor T3 in the off state to reduce the influence of the second electrode (point B) of the driving transistor T1 on the voltage Vg of the gate (point Q) of the driving transistor T1, Using the leakage current characteristic of the initialization transistor T2 in the off state and the potential variable signal VI1 to dynamically compensate the influence of the leakage current of the compensation transistor T3 on the gate voltage Vg of the driving transistor T1, so that the gate voltage Vg of the driving transistor T1 remains stable. That is, Vg is maintained at Vdata+Vth to ensure stable light emission of the light-emitting device D1.

Referring to FIG. 2A to FIG. 2B and FIG. 3A to FIG. 3B, in the light-emitting phase t3, since the first switch transistor T5 is turned on, the first voltage terminal Vdd transmits the signal Vdd1 to the first electrode of the driving transistor T1, and the difference Vgs between the gate voltage Vg of the driving transistor T1 and the voltage at the first pole (point A) is equal to Vg-Vdd1. Therefore, by Vg=Vdata+Vth, Vgs=Vg-Vdd1 and drive current I=(CoxμmW/L)*(Vgs−Vth)$_2$/2, where $C_{ox}$, μm, W, and L are channel capacitance per unit area, channel mobility, channel width, and channel length of the transistor. The drive current I=(CoxμmW/L)*(Vg−Vdd1−Vg+Vdata)$^2$/2=(CoxμmW/L)*(Vdata−Vdd1)$^2$/2. Therefore, the drive current I is not affected by the change of the threshold voltage Vth, which ensures the stability of the light-emitting device D1.

The potential variable signal VI1 is a constant low level signal when the initialization transistor T2 responds to the first scan signal Scan1 and the compensation transistor T3 responds to the compensation control signal Scan3, and is a continuous rising signal in the light-emitting phase t3.

In the pixel driving circuit described in FIG. 2A to FIG. 2B, the driving transistor T1, the data writing transistor T4, the first switch transistor T5, the second switch transistor T6, and the reset transistor are all used T7 is a P-type transistor as an example. Those skilled persons in the art can also replace it with an N-type transistor, and invert the corresponding part of the signal to achieve the above function, which will not be repeated herein.

Figure 4A:
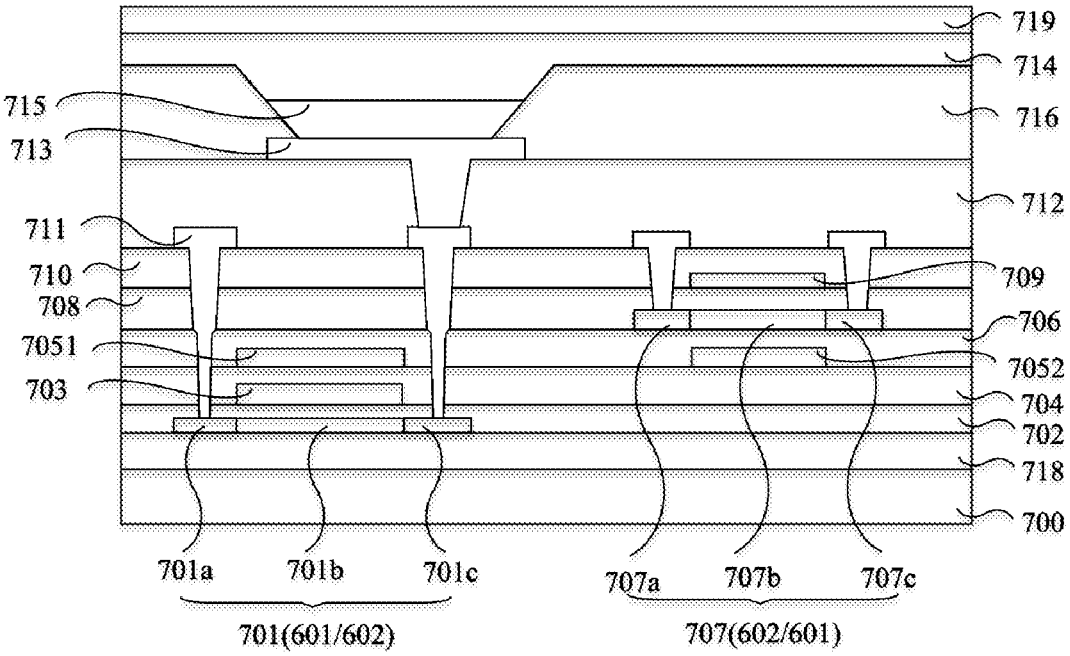
FIG. 4A to FIG. 4C are structural schematic views of a display panel according to one embodiment of the present invention.
Figure 4B:
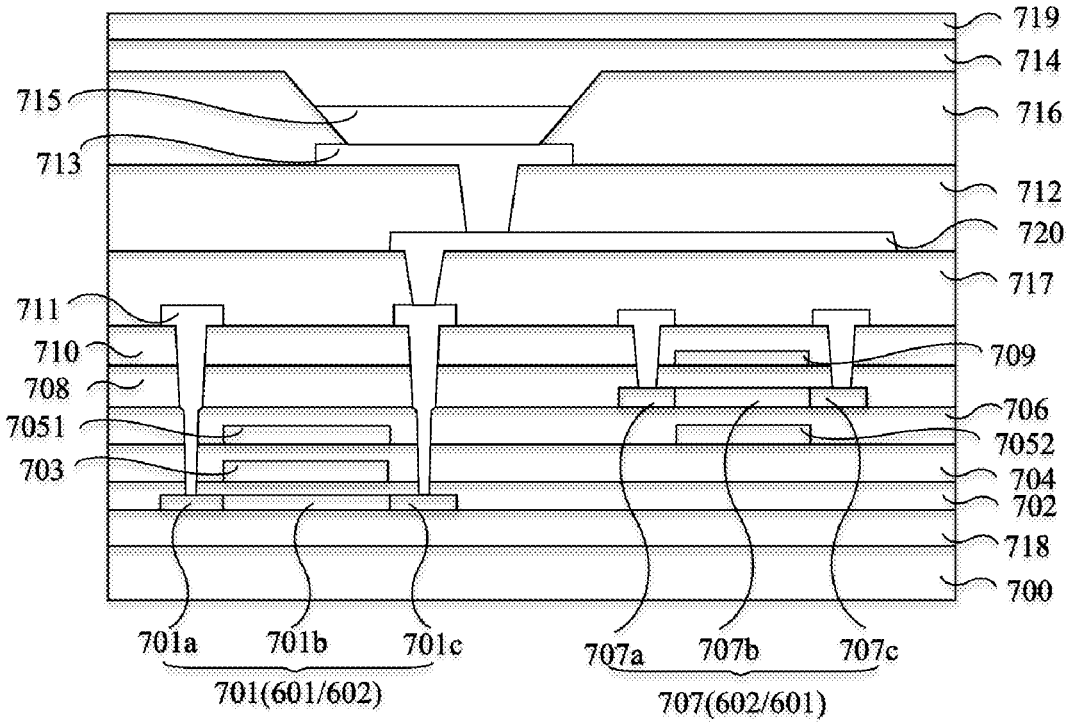
Figure 4C:
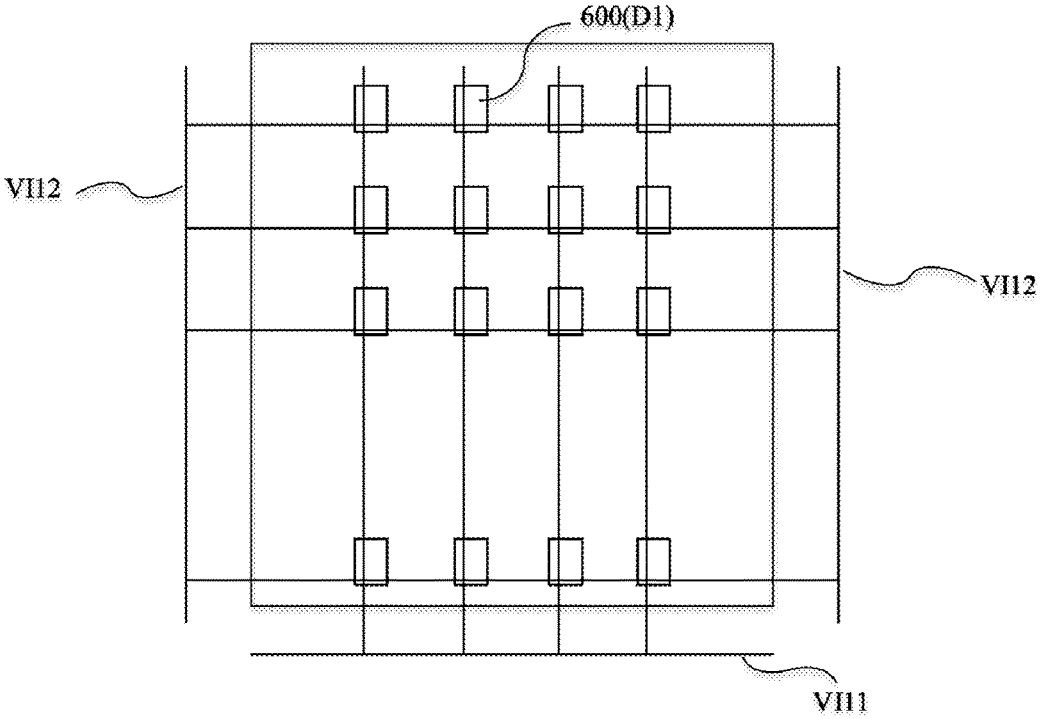
Figure 5A:
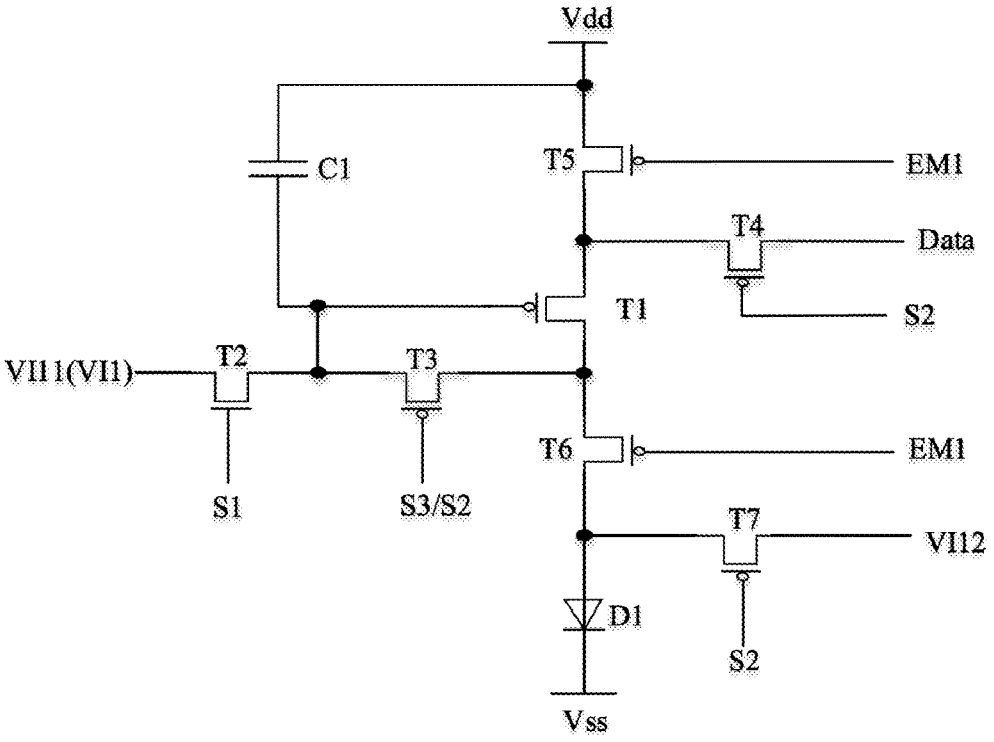
FIG. 5A to FIG. 5B are schematic structural views of pixel driving circuits according to one embodiment of the present invention.
Figure 5B:
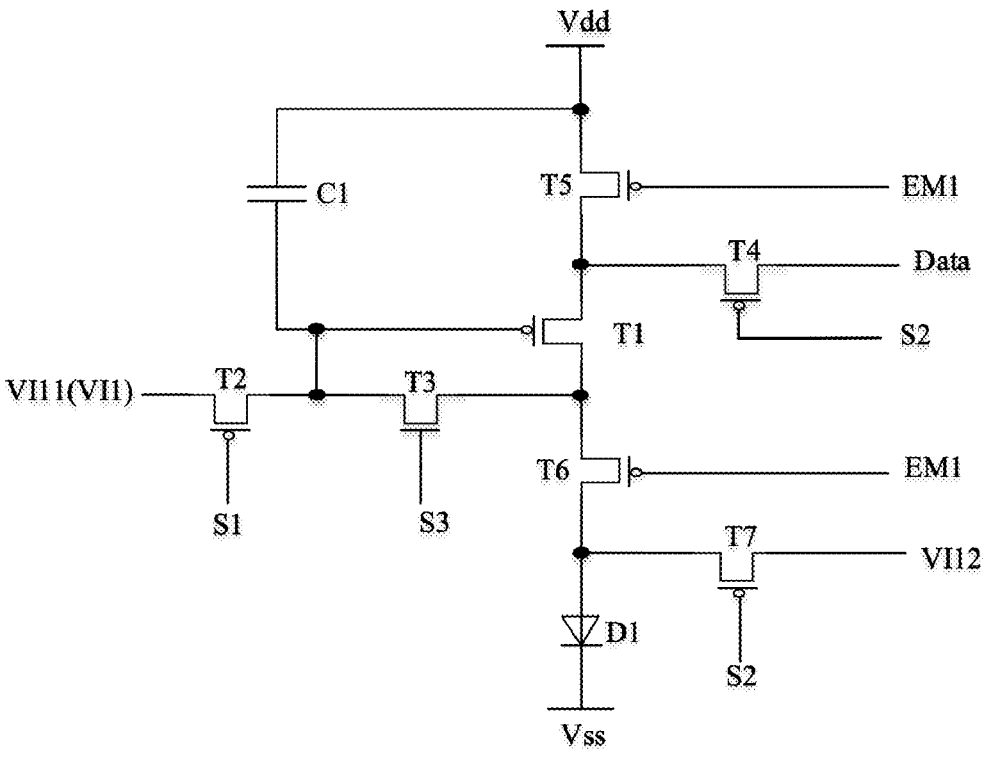

Referring to FIG. 4A to FIG. 4C, which are structural schematic views of a display panel according to one embodiment of the present invention. Referring to FIG. 5A and FIG. 5B, which are schematic structural views of pixel driving circuits according to one embodiment of the present invention.

Furthermore, a display panel comprises: a plurality of pixels 600 and a pixel driving circuit controlling the pixels 600 to emit light, and the pixel driving circuit comprises: a light-emitting device D1 forming the pixels 600; a driving transistor T1 configured to provide a driving current to the light-emitting device; a potential variable signal line VI11 configured to provide potential variable signal VI1; an initialization transistor T2; and a compensation transistor T3. The initialization transistor T2 and the compensation transistor T3 have semiconductor layers made of different materials.

A gate of the compensation transistor T3 is connected to a compensation control signal line S3, one of source or drain of the compensation transistor T3 is connected to a gate of the driving transistor T1, and the other of the source or the drain is connected to a source or a drain of the driving transistor T1.

A gate of the initialization transistor T2 is connected to a scan signal line S1, one of the source or the drain of the initialization transistor T2 is connected to the potential variable signal line VI11, and the other of the source or the drain of the initialization transistor T2 is connected to the gate of the driving transistor T1.

The semiconductor layers 601 and 602 of the initialization transistor T2 and the compensation transistor T3 have different carrier mobilities. A carrier mobility of the semiconductor layer 601 of the initialization transistor T2 is greater than a carrier mobility of the semiconductor layer 602 of the compensation transistor; or a carrier mobility of the semiconductor layer 601 of the initialization transistor T2 is less than a carrier mobility of the semiconductor layer 602 of the compensation transistor T3.

Furthermore, the semiconductor layers 601 and 602 of the initialization transistor T2 and the compensation transistor T3 comprise P-type transistor semiconductors or N-type transistor semiconductors.

Furthermore, the semiconductor layer 601 of the initialization transistor T2 comprises one of a silicon semiconductor layer or an oxide semiconductor layer, and the semiconductor layer 602 of the compensation transistor T3 comprises the other of the silicon semiconductor layer or the oxide semiconductor layer.

Referring to FIG. 5A to FIG. 5B, in some embodiments, the pixel driving circuit further comprises:

a data writing transistor T4, and a gate of the data writing transistor T4 is connected to a second scan signal line S2, one of source or drain of the data writing transistor T4 is connected to a data signal line, and the other of the source or the drain is connected to one of the source or the drain of the driving transistor T1; and a storage capacitor C1, and an upper plate of the storage capacitor C1 is connected to a first voltage terminal Vdd, a lower plate of the of the storage capacitor C1 is connected to a source or a drain of the initialization transistor T2 or a gate of the driving transistor T1, and a source or a drain of the compensation transistor T3 is connected to one of the gate of the driving transistor T1 and the gate of the initialization transistor T2.

The pixel driving circuit further comprises: a first switch transistor T5, and a gate of the first switch transistor T5 is connected to a light-emitting control signal line EM1, one of source or drain of the first switch transistor T5 is connected to a first voltage terminal Vdd, and another of the source or the drain the first switch transistor T5 is connected to one of the source or the drain of the driving transistor T1; and a second switch transistor T6, and a gate of the second switch transistor T6 is connected to the light-emitting control signal line EM1, one of source or drain of the second switch transistor T6 is connected to the source or the drain of the driving transistor T1, and another of the source or the of the driving transistor is connected to an anode of the light-emitting device D1.

The pixel driving circuit further comprises: a reset transistor T7, and a gate of the reset transistor T7 is connected to the second scan signal line S2, one of source or drain of the reset transistor T7 is connected to a reset signal line VI12, and another of the source or the drain of the reset transistor T7 is connected to an anode of the light-emitting device D1.

Furthermore, the reset transistor T7 and the initialization transistor T2 may have semiconductor layers made of different materials, or may have semiconductor layers made of the same material. As shown in FIG. 5A and FIG. 5B. in the pixel driving circuit shown in FIG. 5A, the reset transistor T7 and the initialization transistor T2 have semiconductor layers made of different materials. Furthermore, the reset transistor T7 and the compensation transistor T3 have semiconductor layers made of the same material. In the pixel driving circuit shown in FIG. 5B, the reset transistor T7 and the initialization transistor T2 have semiconductor layers made of the same material. Furthermore, the reset transistor T7 and the compensation transistor T3 have semiconductor layers made of different materials.

In the pixel driving circuit shown in FIG. 5A, the compensation transistor T3 can be connected to the compensation control signal line S3, and can also be connected to the second scan signal line S2 to reduce the difficulty of the manufacturing process.

In the pixel driving circuit shown in FIGS. 5A to 5B, the driving transistor T1, the data writing transistor T4, the first switch transistor T5, the second switch transistor T6, and the reset transistor T7 are P-type transistors as an example, and those skilled persons in the art can also implement it with N-type transistors, which will not be repeated herein.

In the pixel driving circuit of the display panel, the light-emitting device D1 adopts a common cathode connection, that is, the cathode of the light-emitting device D1 is connected to the second voltage terminal Vss as an example, and those skilled in the art can also adopt a common anode connection, that is, the anode of the light-emitting device D1 is connected to the first voltage terminal Vdd, which will not be repeated herein.

Referring to FIG. 4A to FIG. 4C, the display panel further comprises a substrate 700, the pixel driving circuit is disposed on the substrate 700, and the light emitting device D1 is disposed on a side of the pixel driving circuit away from the substrate 700.

The substrate 700 comprises a flexible substrate and a rigid substrate. The material of the substrate 700 comprises glass, quartz, ceramic, plastic or polymer resin, etc. The polymer resin comprises at least one of polyethersulfone, polyacrylate, polyarylate, polyetherimide, polyethylene naphthalate, polyethylene terephthalate, polyphenylene sulfide, polyallyl ester, polyimide, polycarbonate, cellulose triacetate, and cellulose acetate propionate.

The display panel further comprises as follows.

A first semiconductor layer 701 is formed on the substrate 700. The first semiconductor layer 701 comprises a source region 701*a*, a channel region 701*b*, and a drain region 701*c*. The substrate material of the first semiconductor layer 701 can be an N-type or P-type silicon semiconductor.

A first insulating layer 702 covers the substrate 700 and the first semiconductor layer 701. The material of the first insulating layer 702 comprises at least one of silicon nitride, silicon oxide, silicon oxynitride, aluminum oxide, tantalum oxide, hafnium oxide, zirconium oxide, or titanium oxide.

A first gate 703 is formed on a side of the first insulating layer 702 away from the first semiconductor layer 701 and is disposed in alignment with the first semiconductor layer 701. The first gate 703, the source region 701*a*, the channel region 701*b*, and the drain region 701*c* form a source, a gate, and a drain of a silicon transistor. The material of the first gate 703 comprises at least one of molybdenum, aluminum, silver, magnesium, gold, nickel, titanium, tantalum, and tungsten (W). Furthermore, the material of the first gate 703 is molybdenum.

The second insulating layer 704 is formed on a side of the first gate 703 away from the substrate 700. The material of the second insulating layer 704 comprises at least one of silicon nitride, silicon oxide, silicon oxynitride, and aluminum oxide, tantalum oxide, hafnium oxide, zirconium oxide, or titanium oxide.

The second gate layer is formed on a side of the second insulating layer 704 away from the first gate 703. The second gate layer comprises a second gate 7051 arranged in alignment with the first gate 703 and a third gate 7052 arranged away from the second gate 7051. The second gate 7051 and the first gate 703 form an upper plate and a lower plate of the storage capacitor C1 in the pixel driving circuit. The material of the second gate layer comprises at least one of molybdenum, aluminum, silver, magnesium, gold, nickel, titanium, tantalum, tungsten (W), etc. Furthermore, the material of the second gate layer is molybdenum.

The third insulating layer 706 is formed on a side of the second gate layer away from the substrate 700. The material of the third insulating layer 706 comprises at least one of silicon nitride, silicon oxide, silicon oxynitride, and aluminum oxide, tantalum oxide, hafnium oxide, zirconium oxide, or titanium oxide.

The second semiconductor layer 707 is formed on a side of the third insulating layer 706 away from the substrate 700. The second semiconductor layer 707 comprises a source region 707*a*, a channel region 707*b*, and a drain region 707*c*.

The material of the second semiconductor layer 707 is an oxide semiconductor, and the oxide semiconductor comprises at least one of metal oxides of zinc, indium, gallium, tin, or titanium. Furthermore, the oxide semiconductor comprises at least one of zinc oxide, zinc tin oxide, indium zinc oxide, indium oxide, titanium oxide, indium gallium zinc oxide, indium zinc tin oxide, etc.

A fourth insulating layer 708 is formed on a side of the second semiconductor layer 707 away from the substrate 700. The material of fourth insulating layer 708 comprises at least one of silicon nitride, silicon oxide, silicon oxynitride, and aluminum oxide, tantalum oxide, hafnium oxide, zirconium oxide or titanium oxide.

A fourth gate 709 is formed on a side of the fourth insulating layer 708 away from the second semiconductor layer 707 and is disposed in alignment with the third gate 7052. The fourth gate 709, the source region 707*a*, the channel region 707*b*, and the drain region 707*c* of the second semiconductor layer 707 form a source, a gate, and a drain of an oxide transistor. The third gate 7052 constitutes the bottom gate part of the oxide transistor. The material of the fourth gate 709 comprises at least one of molybdenum, aluminum, silver, magnesium, gold, nickel, titanium, tantalum, and tungsten (W). Furthermore, the material of the fourth gate 709 is molybdenum.

A fifth insulating layer 710 is formed on a side of the fourth gate 709 away from the substrate 700. The material of the fifth insulating layer 710 comprises at least one of silicon nitride, silicon oxide, silicon oxynitride, and aluminum oxide, tantalum oxide, hafnium oxide, zirconium oxide, or titanium oxide.

The first metal layer 711 is formed on a side of the fifth insulating layer 710 away from the substrate 700. The first metal layer 711 is connected to the silicon transistor, the gate, the source, and the drain of the oxide transistor, and the gate of the oxide transistor through via hole. The material of the first metal layer 711 comprises at least one of gold, silver, copper, lithium, sodium, potassium, magnesium, aluminum, and zinc.

A sixth insulating layer 712 is formed on a side of the first metal layer 711 away from the substrate 700, and the sixth insulating layer 712 may be made of organic materials, inorganic materials, or combination thereof.

An anode 713 is formed on a side of the sixth insulating layer 712 away from the substrate 700. The material of the anode 713 comprises one of indium tin oxide and indium tin zinc oxide, or a combination of indium tin oxide, indium tin zinc oxide and silver. The anode 713 is electrically connected to the first metal layer 711 through a via hole.

A pixel defining layer 716 is formed on a side of the anode 713 away from the substrate 700, and the shape of the opening of the pixel defining layer 716 is consistent with the pattern of the pixel 600.

A light-emitting layer 715 is in contact with the anode 713 through the opening on the pixel defining layer 716. The light-emitting layer 715 comprises an organic light-emitting material. Furthermore, the light-emitting layer 715 further comprises at least one of a fluorescent material, a quantum dot material, and a perovskite material.

A cathode 714 is disposed on a side of the light-emitting layer 715 and the pixel defining layer 716 away from the anode 713. The anode 713, the cathode 714, and the light-emitting layer 715 between the anode 713 and the cathode 714 form the light-emitting device D1.

A packaging layer 719 is disposed on a side of the light-emitting device D1 away from the substrate 700, and the material of the packaging layer 719 comprises a combination of organic materials and inorganic materials.

In a direction perpendicular to the substrate 700, the first semiconductor layer 701, the first insulating layer 702, the first gate 703, the second insulating layer 704, and the second gate layer, the third insulating layer 706, the second semiconductor layer 707, the fourth insulating layer 708, the fourth gate 709, the fifth insulating layer 710 and the first metal layer 711 form the pixel driving circuit.

In order to prevent the hydrogen and oxygen elements in the packaging layer 719 from affecting the oxide transistor, the display panel further comprises a conductive layer 720 disposed between the pixel driving circuit and the light-emitting device D1. In a top view, the conductive layer 720 overlaps with the orthographic projection of the oxide transistor, and the conductive layer 720 covers the oxide transistor, as shown in FIG. 4B. Furthermore, if the initialization transistor T2 is an oxide transistor, the conductive layer 720 overlaps with the orthographic projection of the initialization transistor T2, and the conductive layer 720 covers the initialization transistor T2. Similarly, if the compensation transistor T3 is an oxide transistor, the conductive layer 720 overlaps with the orthographic projection of the compensation transistor T3, and the conductive layer 720 covers the compensation transistor T3.

Specifically, the display panel further comprises a seventh insulating layer 717, and the seventh insulating layer 717 is disposed on a side of the conductive layer 720 close to the substrate 700. The conductive layer 720 is disposed between the sixth insulating layer 712 and the seventh insulating layer 717, and the conductive layer 720 is connected to the first metal layer 711 through the via hole of the seventh insulating layer 717. The material of the conductive layer 720 comprises at least one of gold, silver, copper, lithium, sodium, potassium, magnesium, aluminum, and zinc. The seventh insulating layer 717 comprises organic materials or inorganic materials and mixtures thereof.

Referring to FIG. 4A to FIG. 4B, the display panel further comprises a buffer layer 718, and the buffer layer 718 comprises organic materials, inorganic materials, and combinations thereof. Specifically, the material of the buffer layer 718 comprises silicon nitride, silicon oxide, silicon oxynitride, etc.

Please referring to FIG. 4C, in the top view, a plurality of pixels 600 are respectively connected to the potential variable signal line VI11 and the reset signal line VI12.

The potential variable signal line VI11 may be disposed in the left and right frame areas of the display panel and extend from the left and right frame areas to the display area of the display panel. The reset signal line VI12 may be disposed in the lower frame area of the display panel and extend from the lower frame area to the display area of the display panel.

The reset signal line VI12 may be connected to a driving chip, and the driving chip is configured to provide the required variable potential signal VI1, so in order to reduce the influence on the left and right frames of the display panel, the potential variable signal line VI11 may be disposed in the lower frame area of the display panel and extend from the lower frame area to the display area of the display panel. The reset signal line VI12 may be disposed in the left and right frame areas of the display panel and extend from the left and right frame areas to the display area of the display panel.

Furthermore, the display panel further comprises a color filter, a touch electrode, and other parts, which are not shown in the drawings.

A pixel driving circuit, a method of driving thereof, and a display panel are provided in the embodiments of the present invention. The pixel driving circuit comprises: a light-emitting device D1, a driving transistor T1, and a compensation module 100. The compensation module 100 at least comprises an initialization transistor T2 and a compensation transistor T3. The initialization transistor T2 is configured to respond to the first scan signal (Scan1) and transmit the potential variable signal VI1 to the gate of the driving transistor T1, and initialize the gate voltage Vg of the driving transistor T1. The compensation transistor T3 is configured to respond to the compensation control signal (Scan3) and transmit the data signal Vdata with the compensation threshold voltage to the gate of the driving transistor T1. The initialization transistor T2 and the compensation transistor T3 are different types.

The variable potential signal VI1 dynamically compensates the gate voltage Vg of the driving transistor T1 during the light-emitting phase, so as to maintain the gate voltage Vg of the driving transistor T1 stable during the light-emitting phase t3, and reduce the influence of the source or drain of the driving transistor T1 on the gate of the driving transistor T1, which improves the display effect of the display panel.

In the above-mentioned embodiments, the description of each embodiment has its own focus. For parts that are not described in detail in an embodiment, reference may be made to related descriptions of other embodiments.

In the above, the pixel driving circuit, the method of driving thereof, and the display panel provided by the embodiments of the present application are described in detail above. The present application has been described in the above preferred embodiments, but the preferred embodiments are not intended to limit the scope of the invention, and a person skilled in the art may make various modifications without departing from the spirit and scope of the application. The scope of the present application is determined by claims.

What is claimed is:

1. A pixel driving circuit, comprising: a light-emitting device, a driving transistor, and a compensation module, wherein the compensation module at least comprises an initialization transistor and a compensation transistor;

wherein the initialization transistor is configured to respond to a first scan signal and transmit a potential variable signal to a gate of the driving transistor to initialize a gate voltage of the driving transistor;

wherein the compensation transistor is configured to respond to a compensation control signal and transmit a data signal with a compensation threshold voltage to the gate of the driving transistor; and wherein the initialization transistor and the compensation transistor are different types, and the potential variable signal dynamically compensates the gate voltage of the driving transistor during light-emitting phase.

2. The pixel driving circuit according to claim 1, wherein the initialization transistor is one of silicon transistor or oxide transistor, and the compensation transistor is another one of the silicon transistor or the oxide transistor.

3. The pixel driving circuit according to claim 2, wherein the initialization transistor is a silicon transistor, and the compensation transistor is an oxide transistor.

4. The pixel driving circuit according to claim 3, wherein the initialization transistor is a P-type transistor, and the compensation transistor is an N-type transistor.

5. The pixel driving circuit according to claim 4, wherein the potential variable signal is a constant low-level signal when the initialization transistor responds to the first scan signal and the compensation transistor responds to the compensation control signal, and the potential variable signal is a continuous rising signal in a light-emitting phase.

6. The pixel driving circuit according to claim 1, further comprising a reset module, wherein the reset module is configured to respond to a second scan signal and transmit a reset signal to an anode of the light-emitting device.

7. The pixel driving circuit according to claim 6, wherein the reset signal is a constant signal.

8. A method of driving a pixel driving circuit, wherein the method drives the pixel driving circuit of claim 1, in the $N_f$h frame period, the method comprising:

in an initialization phase, wherein an initialization transistor of a compensation module responds to a first scan signal, and a potential variable signal is transmitted to a gate of a driving transistor to initialize a gate voltage of the driving transistor;

in a compensation phase, wherein a compensation transistor of the compensation module responds to a compensation control signal to transmit a data signal with a compensation threshold voltage to the gate of the driving transistor to compensate a threshold voltage of the driving transistor; and in a light-emitting phase, wherein the driving transistor drives the light-emitting device to emit light, and the potential variable signal dynamically compensates the gate voltage of the driving transistor.

9. The method of driving the pixel driving circuit according to claim 8, wherein the potential variable signal is a constant signal during the initialization phase and the compensation phase, and the potential variable signal continuously rises or falls with the gate voltage of the driving transistor before compensation in the light-emitting phase.

10. The pixel driving circuit according to claim 1, further comprising a data writing module, wherein the data writing module is configured to respond a second scan signal and transmit the data signal to a source or a drain of the driving transistor.

11. The pixel driving circuit according to claim 1, further comprising a storage module, wherein the storage module is configured to maintain the gate voltage of the driving transistor.

12. The pixel driving circuit according to claim 1, further comprising a light control module, wherein the light control module is configured to control the light-emitting device to emit light in response to a light emitting control signal.

13. The pixel driving circuit according to claim 1, wherein the light emitting device comprises one of an organic light-emitting diode, a sub-millimeter light-emitting diode, and a micro light-emitting diode.

14. A display panel, comprising: a plurality of pixels and a pixel driving circuit controlling the pixels to emit light, wherein the pixel driving circuit comprises:

a light-emitting device forming the pixels;

a driving transistor configured to provide a driving current to the light-emitting device;

a potential variable signal line configured to provide potential variable signal, an initialization transistor; and a compensation transistor;

wherein the initialization transistor and the compensation transistor have semiconductor layers made of different materials;

wherein a gate of the compensation transistor is connected to a compensation control signal line, one of source or drain of the compensation transistor is connected to a gate of the driving transistor, and another of the source or the drain is connected to a source or a drain of the driving transistor; and wherein a gate of the initialization transistor is connected to a scan signal line, one of the source or the drain of the initialization transistor is connected to the potential variable signal line, and another of the source or the drain of the initialization transistor is connected to the gate of the driving transistor;

wherein the display panel further comprises a conductive layer disposed between the pixel driving circuit and the light-emitting device, the conductive layer overlaps with an orthographic projection of the compensation transistor in a top view, and the conductive layer covers the compensation transistor.

15. The display panel according to claim 14, wherein the semiconductor layers of the initialization transistor and the compensation transistor have different carrier mobilities; a carrier mobility of the semiconductor layer of the initialization transistor is greater than a carrier mobility of the semiconductor layer of the compensation transistor; or a carrier mobility of the semiconductor layer of the initialization transistor is less than a carrier mobility of the semiconductor layer of the compensation transistor.

16. The display panel according to claim 14, wherein the pixel driving circuit further comprises:

a data writing transistor, and a gate of the data writing transistor is connected to a second scan signal line, one of source or drain of the data writing transistor is connected to a data signal line, and another of the source or the drain is connected to one of the source or the drain of the driving transistor; and a storage capacitor, and an upper plate of the storage capacitor is connected to a first voltage terminal, a lower plate of the of the storage capacitor is connected to a source or a drain of the initialization transistor or a gate of the driving transistor, and a source or a drain of the compensation transistor is connected to one of the gate of the driving transistor and a gate of the initialization transistor.

17. The display panel according to claim 14, wherein the pixel driving circuit further comprises:

a first switch transistor, and a gate of the first switch transistor is connected to a light-emitting control signal line, one of source or drain of the first switch transistor is connected to a first voltage terminal, and another of the source or the drain the first switch transistor is connected to one of the source or the drain of the driving transistor; and a second switch transistor, and a gate of the second switch transistor is connected to the light-emitting control signal line, one of source or drain of the second switch transistor is connected to the source or the drain of the driving transistor, and another of the source or the of the driving transistor is connected to an anode of the light-emitting device.

18. The display panel according to claim 14, wherein the pixel driving circuit further comprises:

a reset transistor, wherein a gate of the reset transistor is connected to a second scan signal line, one of source or drain of the reset transistor is connected to a reset signal line, and another of the source or the drain of the reset transistor is connected to an anode of the light-emitting device, and the reset transistor and the initialization transistor have a semiconductor layer made of a same material.

19. The display panel according to claim 14, wherein material of the conductive layer comprises at least one of gold, silver, copper, lithium, sodium, potassium, magnesium, aluminum, and zinc.

* * * * *